US008821299B2

(12) United States Patent
Blair et al.

(10) Patent No.: US 8,821,299 B2
(45) Date of Patent: Sep. 2, 2014

(54) PROTECTING WAGERING GAME MACHINES FROM ELECTROSTATIC DISCHARGE

(75) Inventors: Bruce H. Blair, Oak Park, IL (US); Timothy J. Durham, Oak Park, IL (US); Jeremy K. Gill, Chicago, IL (US); James M. Rasmussen, Chicago, IL (US); Francisco D. Salmeron, Chicago (IL); Adam J. Voracek, Chicago, IL (US)

(73) Assignee: WMS Gaming, Inc., Waukegan, IL (US)

( * ) Notice: Subject to any disclaimer, the term of this patent is extended or adjusted under 35 U.S.C. 154(b) by 961 days.

(21) Appl. No.: 12/528,533

(22) PCT Filed: Feb. 27, 2008

(86) PCT No.: PCT/US2008/055121

§ 371 (c)(1),
(2), (4) Date: Aug. 25, 2009

(87) PCT Pub. No.: WO2008/109310

PCT Pub. Date: Sep. 12, 2008

(65) Prior Publication Data

US 2010/0099501 A1 Apr. 22, 2010

Related U.S. Application Data

(60) Provisional application No. 60/892,817, filed on Mar. 2, 2007, provisional application No. 60/914,079, filed on Apr. 26, 2007.

(51) Int. Cl.
*G07F 17/32* (2006.01)
*A63F 9/24* (2006.01)

(52) U.S. Cl.
CPC ..... *G07F 17/3202* (2013.01); *G07F 17/3209* (2013.01)
USPC ..... 463/46

(58) Field of Classification Search
CPC .. G07F 17/32; G07F 17/3202; G07F 17/3209
See application file for complete search history.

(56) References Cited

U.S. PATENT DOCUMENTS 4,412,255 A * 10/1983 Kuhlman et al. ..... 348/819
4,716,497 A * 12/1987 Craker ..... 361/740

(Continued)

OTHER PUBLICATIONS

RTP Company Types of Conductive Materials, p. 1 , retrieved online from http://web.archive.org/web/20060318092224/http://www.rtpcompany.com/products/conductive/types.htm.*

(Continued)

*Primary Examiner* — David L Lewis
*Assistant Examiner* — Shauna-Kay Hall
(74) *Attorney, Agent, or Firm* — DeLizio Gilliam, PLLC

(57) ABSTRACT

Techniques for protecting wagering game machines from electrostatic discharge are described herein. In some embodiment, a wagering game machine includes a wagering game controller configured to present wagering games upon which monetary value can be wagered. The wagering game machine can also include a button panel that includes a first printed circuit board (PCB) connected to an electrical ground and a second PCB connected to the first PCB by a conductive connector. The button panel can also include a display device connected to the second PCB, an actuator connected to the second PCB, a cap in contact with the actuator, wherein the display device is visible through the cap, and a bezel to retain the cap, where the bezel is coupled to a panel.

26 Claims, 14 Drawing Sheets

(56) References Cited

U.S. PATENT DOCUMENTS

| | | | | |
|---|---|---|---|---|
| 5,063,474 | A * | 11/1991 | Igarashi | 361/220 |
| 5,278,362 | A * | 1/1994 | Ohashi | 200/5 A |
| 5,557,064 | A * | 9/1996 | Isern-Flecha et al. | 174/393 |
| 5,661,279 | A * | 8/1997 | Kenmochi | 200/314 |
| 6,102,394 | A * | 8/2000 | Wurz et al. | 273/138.2 |
| 6,848,950 | B2 * | 2/2005 | Allison et al. | 439/682 |
| 6,987,233 | B2 * | 1/2006 | Cole et al. | 200/341 |
| 7,030,860 | B1 * | 4/2006 | Hsu et al. | 345/173 |
| 7,060,922 | B2 | 6/2006 | Hoehne et al. | |
| 7,628,692 | B2 * | 12/2009 | Kaminkow | 463/20 |
| 7,775,872 | B2 * | 8/2010 | Bleich et al. | 463/20 |
| 2004/0118669 | A1 * | 6/2004 | Mou | 200/310 |
| 2004/0158975 | A1 * | 8/2004 | Kawaguchi et al. | 29/622 |
| 2004/0266517 | A1 * | 12/2004 | Bleich et al. | 463/20 |
| 2005/0124417 | A1 * | 6/2005 | Sosnoski et al. | 463/46 |
| 2005/0230233 | A1 * | 10/2005 | Hoehne et al. | 200/314 |
| 2008/0113707 | A1 * | 5/2008 | Nesemeier et al. | 463/16 |
| 2009/0312083 | A1 * | 12/2009 | Rasmussen | 463/20 |

OTHER PUBLICATIONS

Plastics International—ESD materials ; retrived online from http://web.archive.org/web/20060314011344/http://www.plasticsintl.com/esd.htm.*

"PCT Application No. PCT/US2008/055121 International Search Report", Aug. 8, 2008 , 12 pages.

"Types of Conductive Materials", *Conductive and Antistatic Plastic Compounds* (online) http://web.archive.org/web/20060318092224/http://www.rtpcompany.com/index.htm Mar. 18 2006.

"PCT Application No. PCT/US2008/055121 International Preliminary Report on Patentability", Aug. 12, 2009 , 9 pages.

* cited by examiner

SECTION A-A

PROTECTING WAGERING GAME MACHINES FROM ELECTROSTATIC DISCHARGE

RELATED APPLICATIONS

This application claims the priority benefit of U.S. Provisional Application Ser. No. 60/892,817 filed Mar. 2, 2007 and U.S. Provisional Application Ser. No. 60/914,079 filed Apr. 26, 2007.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2008, WMS Gaming, Inc.

FIELD

Embodiments of the inventive subject matter relate generally to wagering game systems, and more particularly to protecting wagering game machines from electrostatic discharge.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

SUMMARY

In some embodiments, a wagering game machine comprises a wagering game controller configured to present wagering games upon which monetary value can be wagered; one or more buttons configured to generate input for use in association with the wagering games, each of the one or more buttons including, an electronic display configured to display information associated with the wagering games; a cap through which the electronic display device is visible; and a conductive bezel configured to contain the cap.

In some embodiments, the one or more buttons further include a conductive liner disposed between the cap and the electronic display, wherein the liner is connected to a grounded panel, and wherein a surface of the cap includes static dissipative material.

In some embodiments, a surface of the cap includes static dissipative material.

In some embodiments, the cap is constructed of dielectric material.

In some embodiments, the electronic display includes one or more selected from the group comprising an organic light emitting diode display, a liquid crystal display, and a plasma display.

In some embodiments, the conductive bezel is coated with conductive material.

In some embodiments, a button assembly configured to generate input for use in association with a wagering game, the button assembly comprises a printed circuit board (PCB) connected to an electrical ground path; an electronic display connected to the PCB by a conductive coupling, wherein the electronic display is configured to display information associated with the wagering game; a conductive cover for covering the electronic display, wherein conductive cover is connected to the conductive coupling.

In some embodiments, the electronic display includes an organic light emitting diode display.

In some embodiments, the button assembly further comprises the conductive coupling includes a frame to support the electronic display, and the conductive cover covers the frame.

In some embodiments, the button assembly further comprises a first shield backing the PCB; a second shield backing another PCB, wherein the first and second shields are connected to the electrical ground path.

In some embodiments, the conductive cover covers the PCB.

In some embodiments, the conductive cover includes a conductive window through which the electronic display is visible.

In some embodiments, the button assembly further comprises a connector header to connect the PCB to another PCB, wherein the ground path runs through the connector header and the other PCB.

In some embodiments, the button assembly further comprises an actuator connected to the PCB; and a cap for actuating the actuator, wherein the electronic display is visible through the cap.

In some embodiments, a wagering game machine comprises a wagering game controller configured to present wagering games upon which monetary value can be wagered; a button panel including, a first printed circuit board (PCB) connected to an electrical ground; a second PCB connected to the first PCB by a conductive connector; a display device connected to the second PCB; an actuator connected to the second PCB; a cap in contact with the actuator, wherein the display device is visible through the cap; and a bezel to retain the cap, wherein the bezel is coupled to a panel.

In some embodiments, the cap includes static dissipative material, and wherein the bezel includes a conductive material, and wherein the panel is connected to an electrical ground.

In some embodiments, the wagering game further comprises a conductive liner disposed between the cap and the display.

In some embodiments, the wagering game further comprises a frame to support the display device, wherein the frame includes a conductive window through which the display device is visible, and wherein the frame is connected to the second PCB.

In some embodiments, the frame, the actuator, the connector and the first PCB form a path to the electrical ground.

In some embodiments, the wagering game further comprises a dielectric shroud covering the display device and the second circuit board.

In some embodiments, the wagering game further comprises a flexible conductive cover disposed between the display device and the cap.

In some embodiments, the wagering game further comprises a conductive shroud covering the display device and the first and second PCBs, wherein the conductive shroud and the second PCB form a path to the electrical ground, and wherein the conductive shroud, the connector, and the first PCB form a path to the electrical ground.

In some embodiments, the wagering game further comprises a spring coupled to the actuator and the first PCB, wherein the spring is electrically connected to the electrical ground, wherein the cap is constructed of static dissipative material, wherein the actuator includes a conductive coating.

In some embodiments, the display device is configured to present information generated by the wagering game controller.

BRIEF DESCRIPTION OF THE FIGURES

Embodiments of the invention are illustrated in the Figures of the accompanying drawings in which.

DESCRIPTION OF THE EMBODIMENTS

This description of the embodiments is divided into five sections. The first section gives a brief introduction, whereas the second section describes an operating environment. The third section describes electrostatic-discharge-resistant buttons for use in wagering game machines. The fourth section describes wagering game machines in more detail and the fifth section presents some general comments.

Introduction

This section provides a brief introduction to some embodiments of the invention.

Electrostatic discharge (ESD) can cause numerous problems for wagering game machines. For example, ESD can short-out electronic components, cause unexpected results, and otherwise interfere with normal operations. Most components in wagering game machine are stored in a case that is resistant to ESD. However, some components are left exposed to ESD. Typical wagering game machine buttons include electronics for generating input signals, but not much else. Because typical buttons do not include many electronic components, they are not typically hardened to withstand intense electrostatic discharge (ESD). In contrast, some embodiments of the invention include hardened buttons that have complex electronics. In some embodiments, the buttons can include organic light emitting diode displays, printed circuit boards, and processors protected by various ESD-resistant shields, liners, covers, etc.

The following sections describe these and other features.

Operating Environment

This section describes an example operating environment for some embodiments of the invention. More specifically, this section includes discussion about wagering game machines and button panels.

Wagering Game Machines

Figure 1:
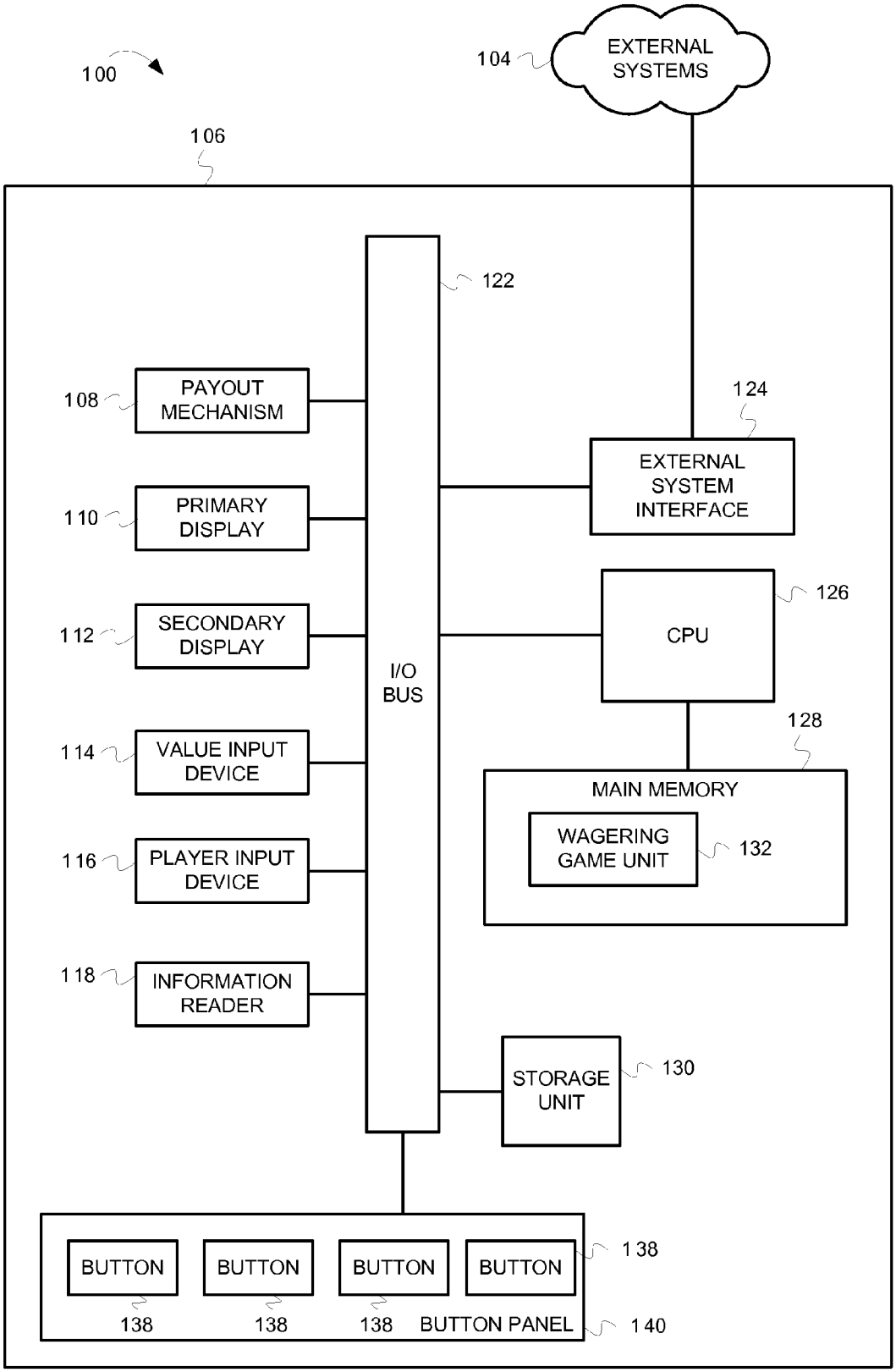
FIG. 1 is a block diagram illustrating a wagering game machine architecture, according to example embodiments of the invention.

FIG. 1 is a block diagram illustrating a wagering game machine architecture, according to example embodiments of the invention. In FIG. 1, the wagering game machine architecture 100 includes a wagering game machine 106. The wagering game machine 106 includes a central processing unit (CPU) 126 connected to main memory 128, which includes a wagering game unit 132. The CPU 126 can include any suitable processor, such as an Intel® Pentium processor, Intel® Core 2 Duo processor, AMD Opteron™ processor, or UltraSPARC processor. In one embodiment, the wagering game unit 132 can present wagering games, such as video poker, video black jack, video slots, video lottery, etc., in whole or part.

The CPU 126 is also connected to an input/output (I/O) bus 122, which facilitates communication between the wagering game machine's components. The I/O bus 122 can include any suitable bus technologies, such as an AGTL+frontside bus and a PCI backside bus. The I/O bus 122 is connected to a payout mechanism 108, primary display 110, secondary display 112, value input device 114, player input device 116, information reader 118, and storage unit 130. The player input device 116 can include the value input device 114 to the extent the player input device 116 is used to place wagers. The I/O bus 122 is also connected to an external system interface 124, which is connected to external systems 104 (e.g., wagering game networks).

The wagering game machine 106 also includes a button panel 140 that includes a plurality of buttons 138. When pressed, the buttons 138 can generate input signals used by the wagering game unit 132 in presenting wagering games. Although not shown in FIG. 1, each button 138 can include one or more switches, variable displays, support mechanisms, adapter boards, sockets, caps, bezels, panels, shrouds, and other components. In some embodiments, some button components (e.g., caps, bezels, panels, shrouds, etc.) can include dielectric materials/coatings, conductive materials/coatings, and/or materials/coatings that dissipate static electricity.

Each of the buttons 138 can present wagering game results and/or other wagering game information. Additionally, each button 138 can present indicia on different areas of the button, where the indicia indicate input signals that will be generated when different areas of the button are pressed. In some embodiments, the wagering game unit 132 configures the button panel 140 based on the type of games being presented. For example, the wagering game unit 132 can configure the buttons 138 with one set of indicia for slots games and different sets of indicia for poker, blackjack, and other games.

In one embodiment, any of the components of the wagering game machine 106 (e.g., the wagering game unit 132) can include hardware, firmware, and/or machine readable media including instructions for performing the operations described herein. Machine-readable media includes any mechanism that provides (i.e., stores and/or transmits) information in a form readable by a machine (e.g., a wagering game machine, processor, etc.). For example, tangible machine-readable media includes read only memory (ROM), random access memory (RAM), magnetic disk storage media, optical storage media, flash memory machines, etc. Machine-readable media also includes any media suitable for transmitting software over a network. Furthermore, in some embodiments, the components of the wagering game machine 106 can be interconnected according to any suitable interconnection architecture (e.g., directly connected, hypercube, etc.).

Button Panels

Figure 2:
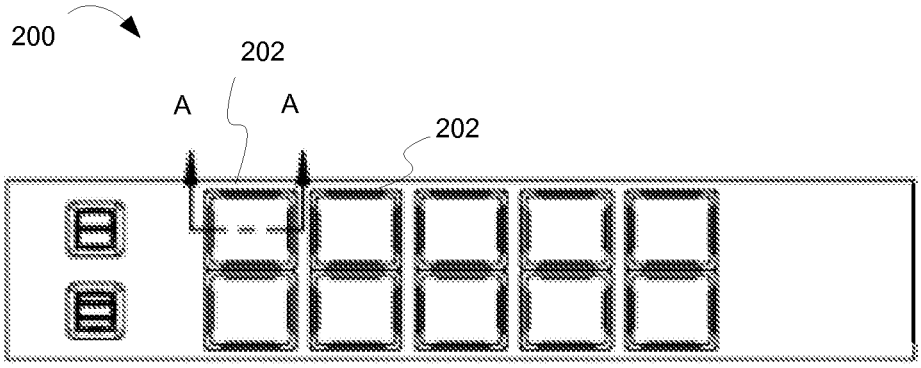
FIG. 2 shows a button panel, according to some embodiments of the invention.

FIG. 2 shows a button panel, according to some embodiments of the invention. As shown, the button panel 200 is suitable for use in a wagering game machine. The button panel 200 can include any number of buttons 202. The buttons 202 can include electronic components that present wagering game results and/or other wagering game information. The buttons 202 can be hardened using any combination of the embodiments described below.

Buttons Assemblies

This section describes buttons and button components used in connection with embodiments of the inventive subject matter. This section will describe FIGS. 3-12.

Figure 3:
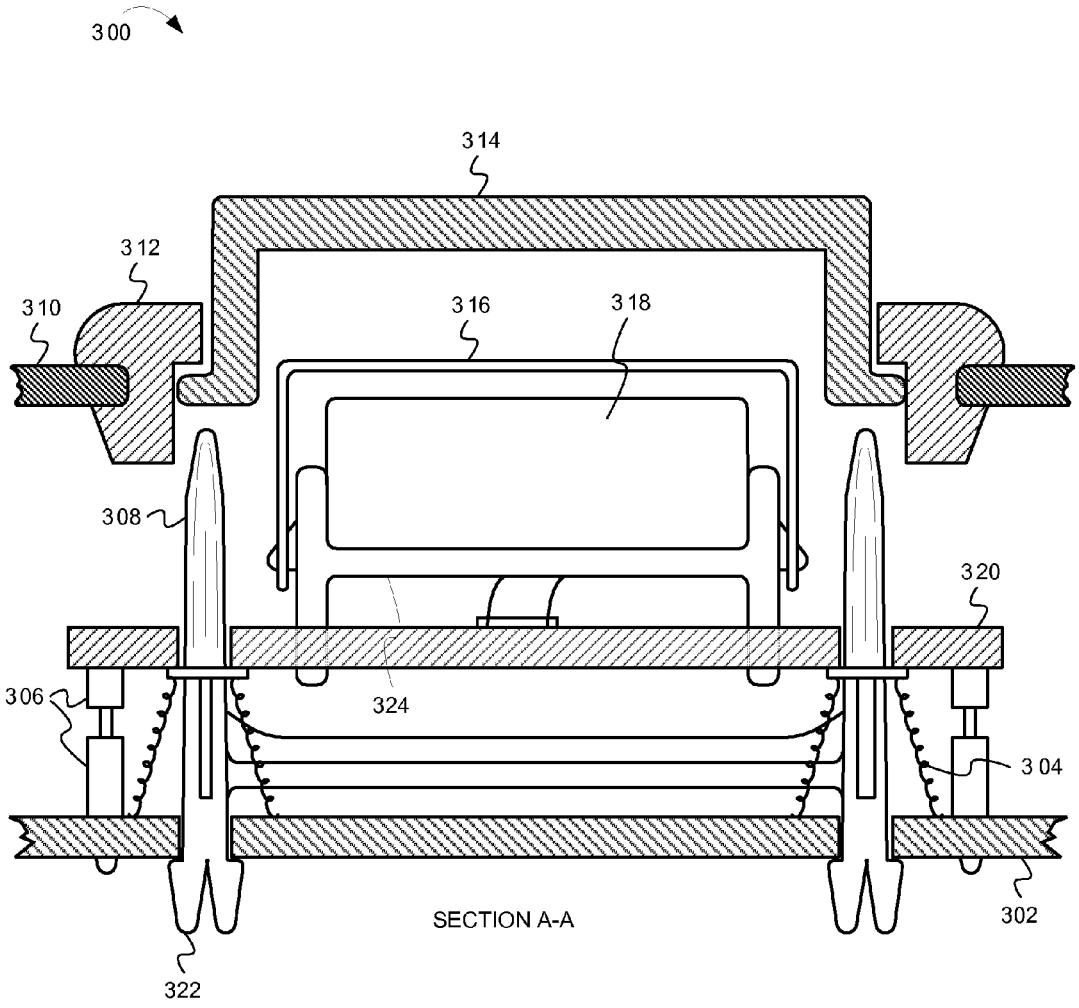
FIG. 3 is a cross-sectional view of a button assembly, according to some embodiments of the invention.

FIG. 3 is a cross-sectional view of a button assembly, according to some embodiments of the invention. In FIG. 3, the button assembly 300 is mounted to a wagering game machine's main printed circuit board (PCB) 302 and panel 310. The button assembly 300 includes a bezel 312 connected to the panel 310. The bezel 312 retains a cap 314. In some embodiments, the cap 314 extends beneath all sides of the bezel 312. In other embodiments, the cap 314 extends beneath the bezel 312 at several points (e.g. at the corners), leaving gaps between the cap 314 and bezel 312. The cap 314 sits atop a plurality of switch actuators 308. As a result, players can press the cap 314 to activate the button. In some embodiments, the cap 314 can move upward and downward or it can tilt off-axis. In some embodiments, the cap 314 can include a lens for focusing and/or magnifying an image visible through the cap 314.

The switch actuators 308 pass through a display PCB 320 and ride on actuator springs 304. The switch actuators 308 are supported by studs 322 that are anchored to the main PCB 302. The display PCB 320 is connected to the main PCB 302 by a connector header 306.

The display PCB 320 supports a frame 324, which holds an organic light emitting diode (OLED) display 318. The OLED display 318 can present video content, such as animation, wagering game information, etc. The OLED display 318 is held in place by a cover 316. The cover 316 can include a cutout (not shown), so the OLED display's video content can be viewed through the cap 314. Although FIG. 3 shows an OLED display, other embodiments include other electronic display devices. The display devices can be variable displays (e.g., liquid crystal display devices, plasma display devices), addressable displays (e.g., seven segment display devices), or static displays (e.g., incandescent lighting and artwork). Additionally, the display devices can include any suitable programmable electronic components.

While FIG. 3 shows a one embodiment of a button assembly, FIGS. 4-13 show other embodiments in which components of a button assembly are fortified to resist against harmful effects of ESD.

Figure 4:
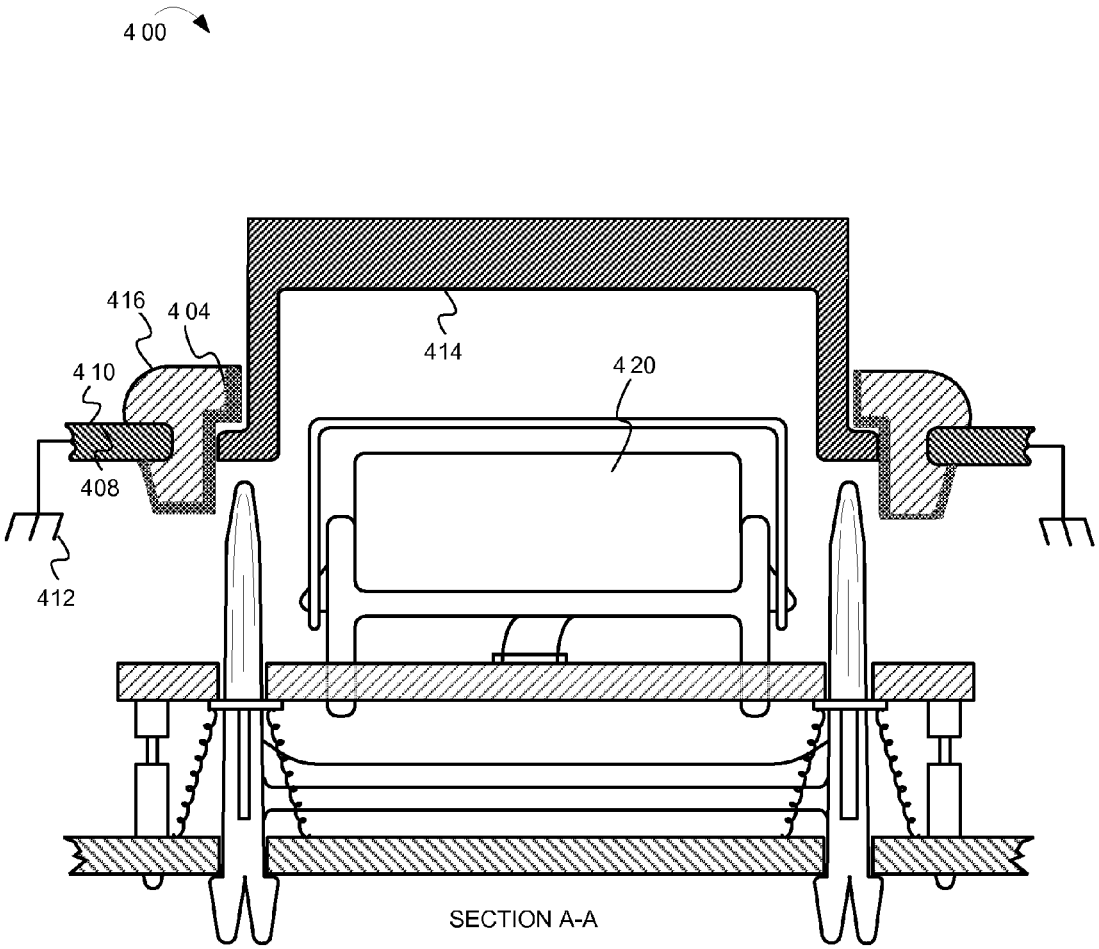
FIG. 4 is a cross-sectional view of a button assembly including a conductive bezel and dielectric cap, according to some embodiments of the invention.

FIG. 4 is a cross-sectional view of a button assembly including a conductive bezel and dielectric cap, according to some embodiments of the invention. In FIG. 4, the button assembly 400 is similar to that shown in FIG. 3, but some components have been modified to protect the OLED display 420 and other electronic components from ESD.

In FIG. 4, the cap 414 is thicker than that shown in FIG. 3. As a result, the cap 414 is composed of more dielectric material, such as polycarbonate material. The bezel 416 includes a conductive coating 404 on its outer surface. The panel 410 is constructed of conductive metal and is connected to an electrical ground 412. As a result, there is a ground path running from the bezel 416, through the panel 410, to the electrical ground 412. The electrical ground 412 can be connected to a chassis ground or other electrical grounding source.

The increased thickness and dielectric material in the cap 414, the conductive coating on the bezel 416, the panel 410, and the electrical ground 412 form a barrier to protect the button assembly's electronic components (e.g., the OLED 420) from ESD.

Figure 5:
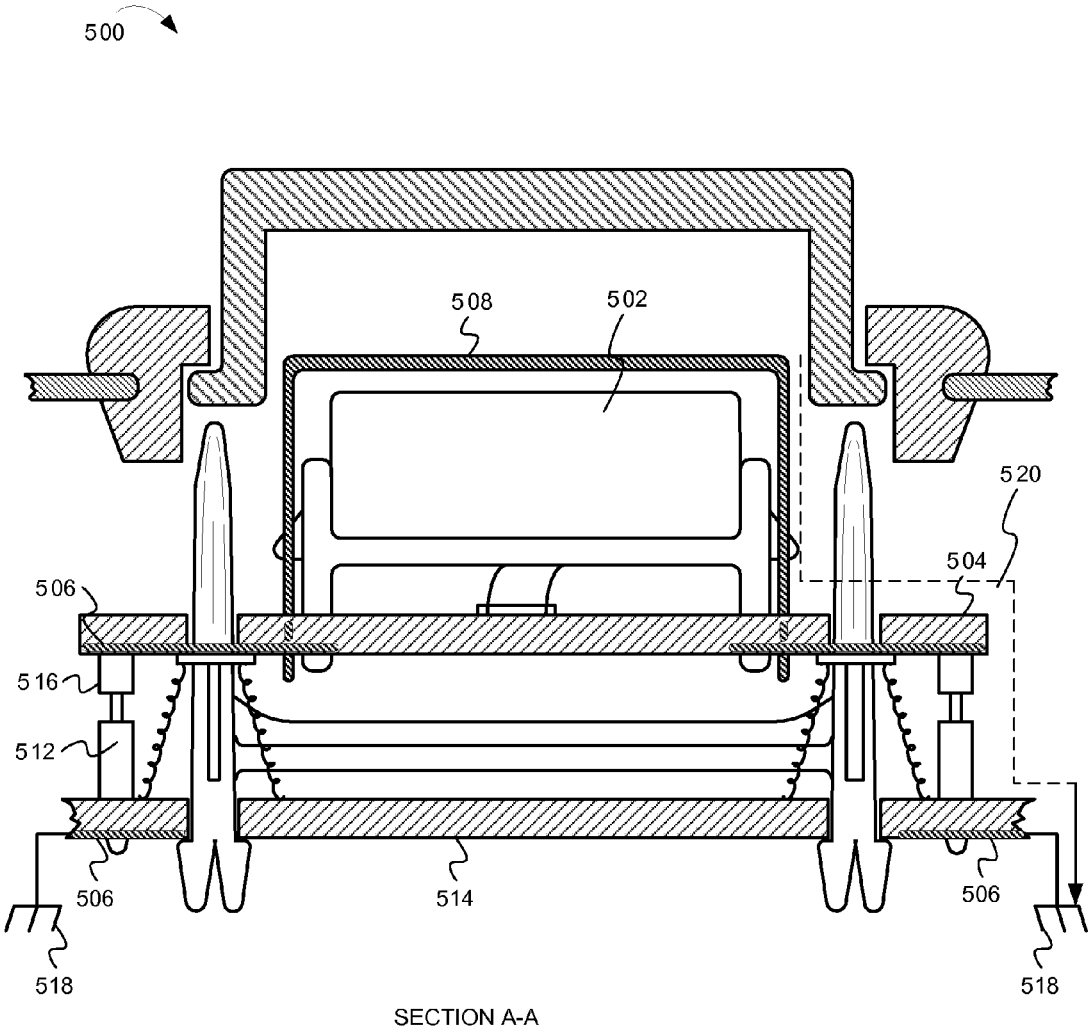
FIG. 5 is a cross-sectional view of a button assembly including a conductive shield surrounding an OLED display, where the shield is connected to one or more ground paths.

FIG. 5 is a cross-sectional view of a button assembly including a conductive shield surrounding an OLED display, where the conductive shield is connected to one or more ground paths. In FIG. 5, the button assembly 500 includes a conductive shield 508 surrounding the OLED display 502. The conductive shield 508 sits on the display PCB 504, while the ground paths 506 are underneath the display PCB 504 and the main PCB 514. In some embodiments, there can be a single ground path 506 spanning the entire PCB 504, instead of two ground paths 506 under the display PCB 504. Similarly, there can be one larger ground path 506 under the main PCB 514. The main PCB 514 is connected to an electrical ground 518. The conductive shield 508 can be constructed from metal or other conductive materials.

A connector header 516 connects the main PCB 514 and the display PCB 504. In some embodiments, the ground paths 506 are in contact with the connector header 516. In some embodiments, there are electrical ground paths running through the conductive shield 508, display PCB ground paths 506, the connector headers 516, and main PCB ground paths 506, terminating at the electrical grounds 518 (see dotted line 520).

Any of the components described herein can be mixed and matched to form embodiments of the invention. For example, the dielectric cap and conductive panel of FIG. 4 can be used with the shields and ground paths of FIG. 5. This section continues with a discussion of embodiments shown in FIG. 6.

Figure 6:
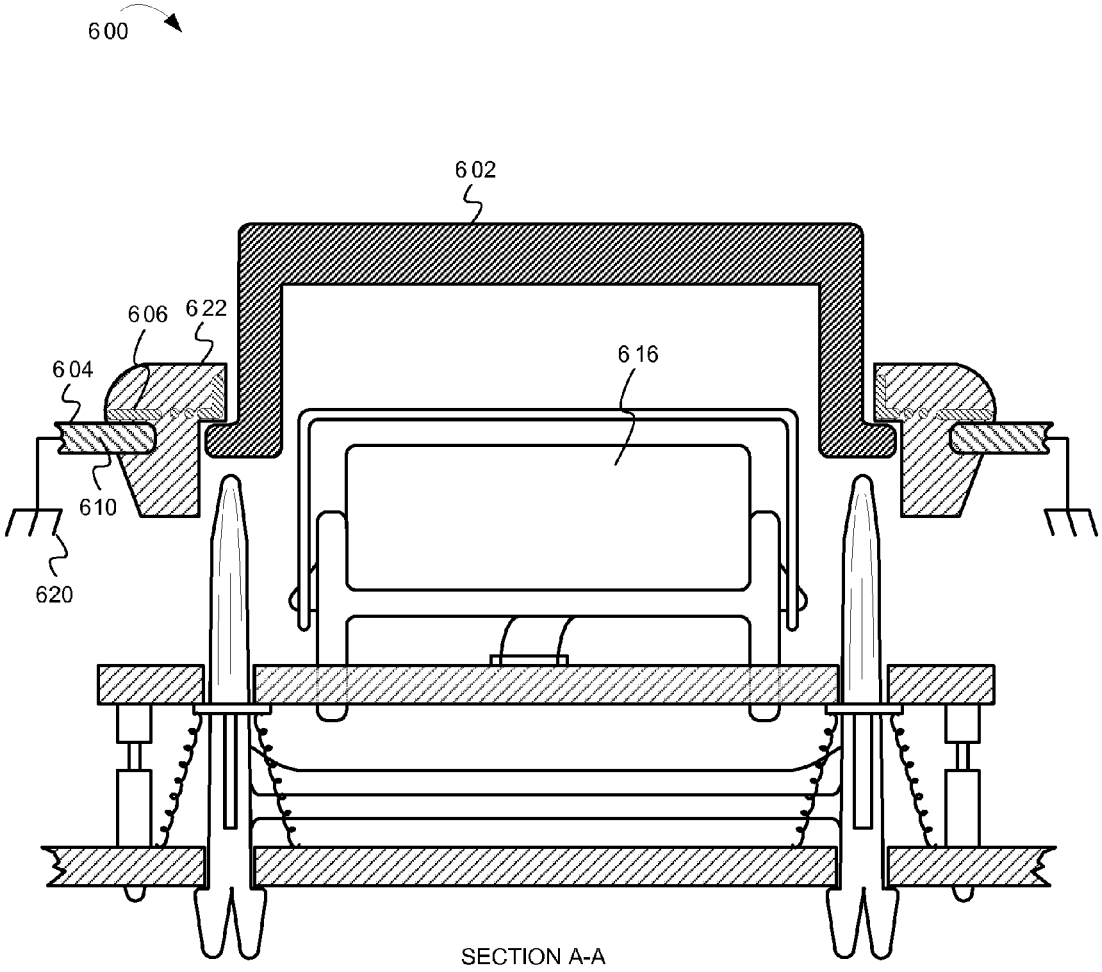
FIG. 6 is a cross-sectional view of a button assembly including a conductive bezel and static dissipative cap, according to some embodiments of the invention.

FIG. 6 is a cross-sectional view of a button assembly including a conductive bezel and static dissipative cap, according to some embodiments of the invention. In FIG. 6, the button assembly 600 includes an OLED display 616 and other electronic components underneath a cap 602, bezel 622, and panel 604. The bezel 622 retains the cap 602 and is in contact with the panel 604. The panel 604 connected to one or more electrical grounds 620, forming a ground path through the bezel 622 and panel 604 to the electrical grounds 620.

The cap 602 can be made of or coated with a static dissipative material, such as RTP's Permastat™. The bezel 622 can be constructed from a conductive material (e.g., metal) or it can be covered with a conductive coating 606 (e.g., a conductive coating supplied by Seleco of Indianapolis, Ind.). As a result, the cap 602, bezel 622, and panel 604 form a barrier protecting the OLED display 616 and other electronic components from ESD. This section continues with a discussion of embodiments shown in FIG. 7.

Figure 7:
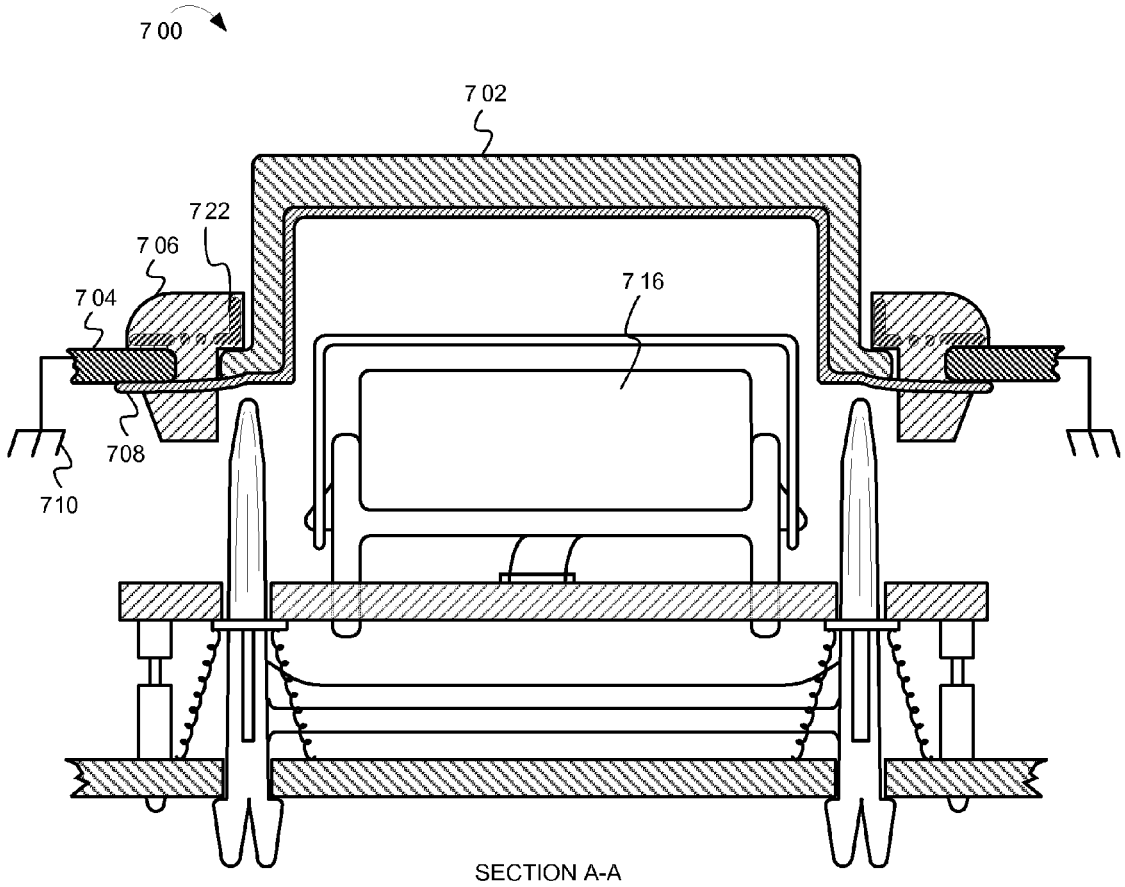
FIG. 7 is a cross-sectional view of a button assembly including a conductive liner, conductive bezel, and grounded panel, according to some embodiments of the invention.

FIG. 7 is a cross-sectional view of a button assembly including a conductive liner, conductive bezel, and grounded panel, according to some embodiments of the invention. In FIG. 7, the button assembly 700 includes a panel 704, bezel 706, and cap 702. The assembly 700 also includes a liner 708 beneath the cap 702.

Accordingly, the bezel 706 includes a conductive coating 722, while the panel 704 is grounded to an electrical ground 710. In some embodiments, the liner 708 can be approximately 1/100 of an inch thick and made from or coated with a conductive material (e.g., tin indium oxide). The liner 708 is in contact with the panel 704, forming ground path running through the liner 708, bezel 706, and panel 704, terminating at the electrical ground 710. As a result, the panel 704, bezel 706, cap 702, and liner 708 form a barrier protecting the OLED display 716 and other electronic components from ESD.

Figure 8:
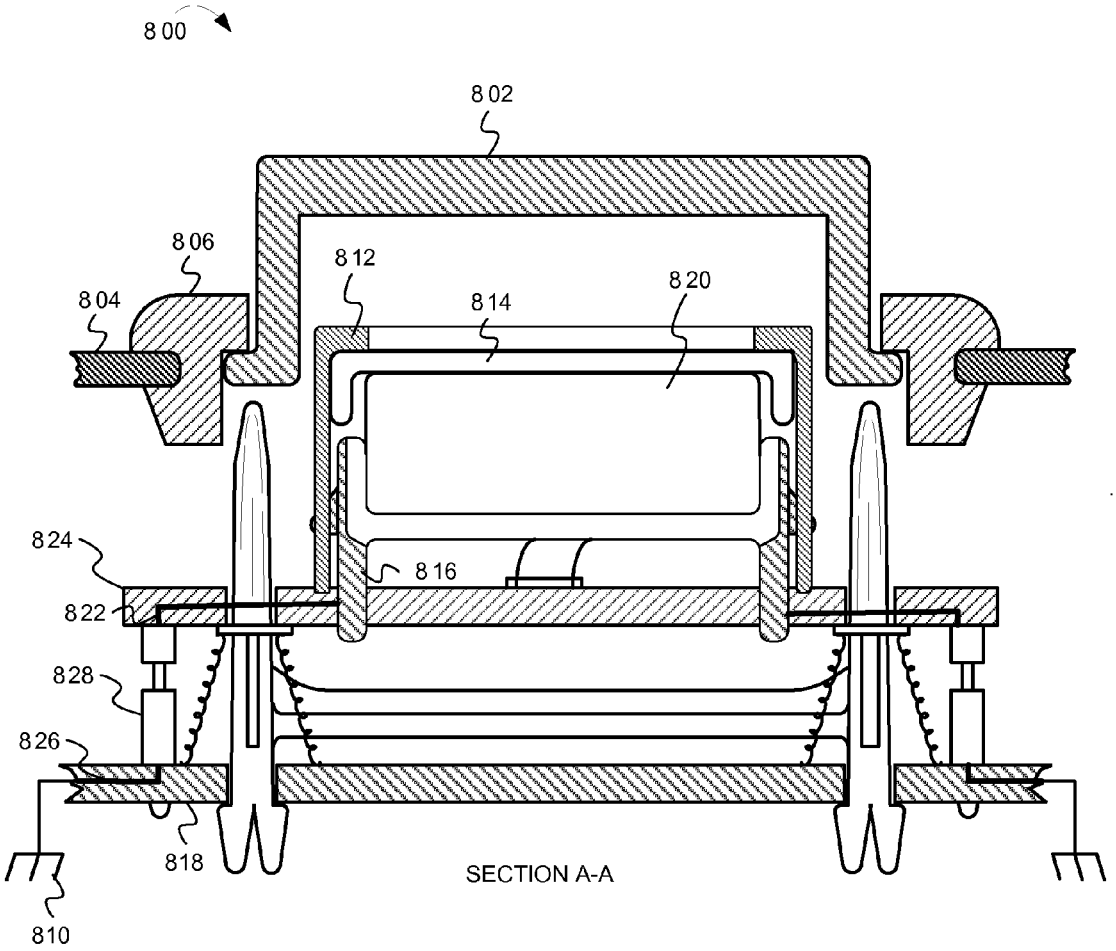
FIG. 8 is a cross-sectional view of a button assembly including a metal frame surrounding an OLED display and a conductive window over the OLED display, according to some embodiments of the invention.

This section continues with a discussion of embodiments shown in FIG. 8.

FIG. 8 is a cross-sectional view of a button assembly including a metal frame surrounding an OLED display and a conductive window over the OLED display, according to some embodiments of the invention. In FIG. 8, the button assembly 800 includes a panel 804, bezel 806, and cap 802. An OLED display 820 sits beneath the cap 802. A conductive cover 812 surrounds the OLED display 820, while a conductive window 814 fits in or atop the conductive cover 812. The conductive cover 812 is connected to a frame 816. The frame 816 can be constructed from or coated with a conductive material. In some embodiments in which the frame 816 is constructed of a conductive material, the OLED display 820 is insulated from the frame 816. The frame 816 can be connected to a conductive path 822 running through the display PCB 824. The conductive path 822 is connected to a connector header 828, which is connected to an electrical ground 810 via another conductive path 826. As a result, a ground path runs from the conductive window 814, through the conductive cover 812, along the conductive paths 822, connector header, and conductive path 826, terminating at the electrical ground 810. As a result, the button assembly 800 can protect the OLED display 820 and other electronic components from harmful ESD. This section continues with a discussion of embodiments shown in FIG. 9.

Figure 9:
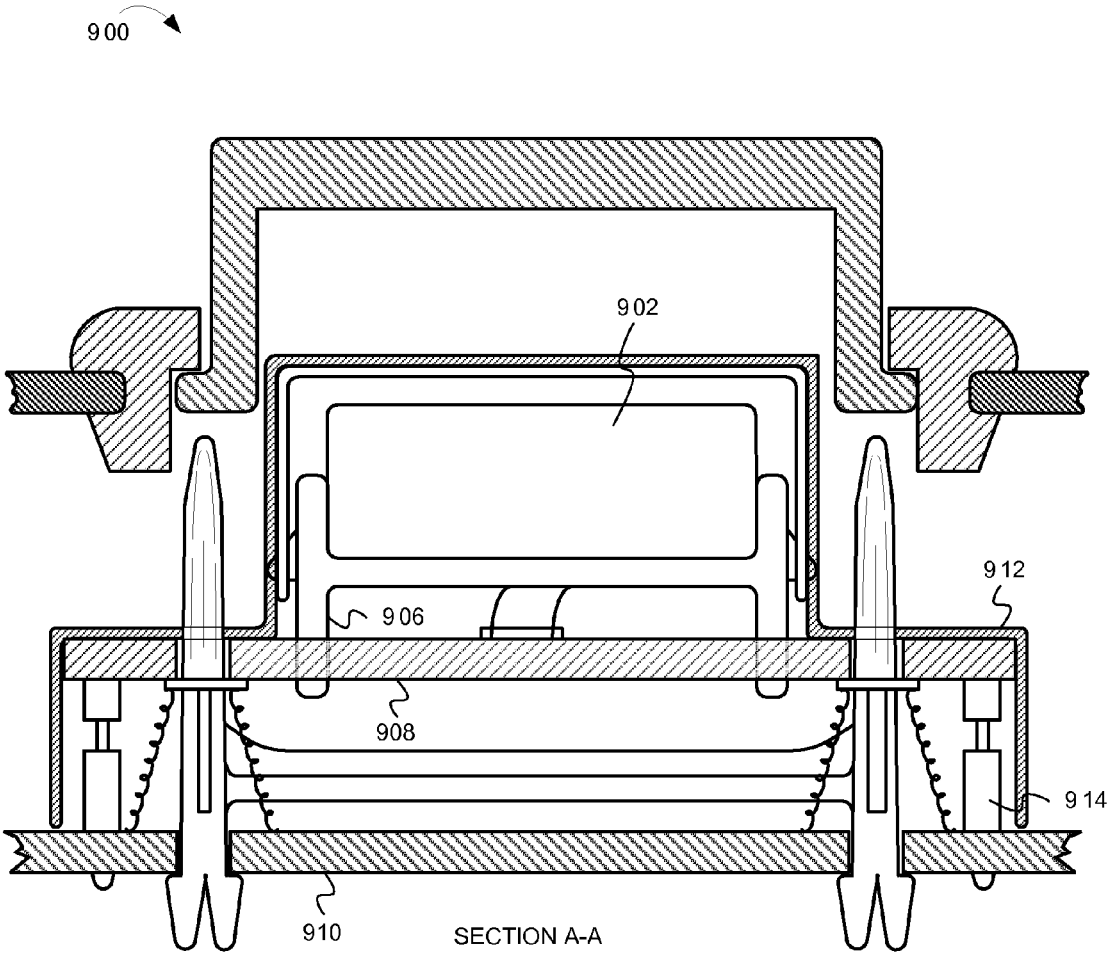
FIG. 9 is a cross-sectional view of a button assembly including a dielectric shroud covering electronic components, according to some embodiments of the invention.

FIG. 9 is a cross-sectional view of a button assembly including a dielectric shroud covering electronic components, according to some embodiments of the invention. In FIG. 9, the button assembly 900 includes an OLED display 902 mounted on a frame 906, where the frame 906 is connected to a display PCB 908. The display PCB 908 is connected to a main PCB 910 by a connector header 914. The button assembly 900 also includes a dielectric shroud 912 covering the OLED display 902, frame 906, and display PCB 908. The dielectric shroud 912 can extend down to the main PCB 910 (as shown) or it can be smaller. The dielectric shroud 912 can be made of any suitable transparent dielectric plastic. As a result, the dielectric shroud 912 can protect the OLED display 902, display PCB 908, and other electronic components from ESD. This section continues with a discussion of embodiments shown in FIG. 10.

Figure 10:
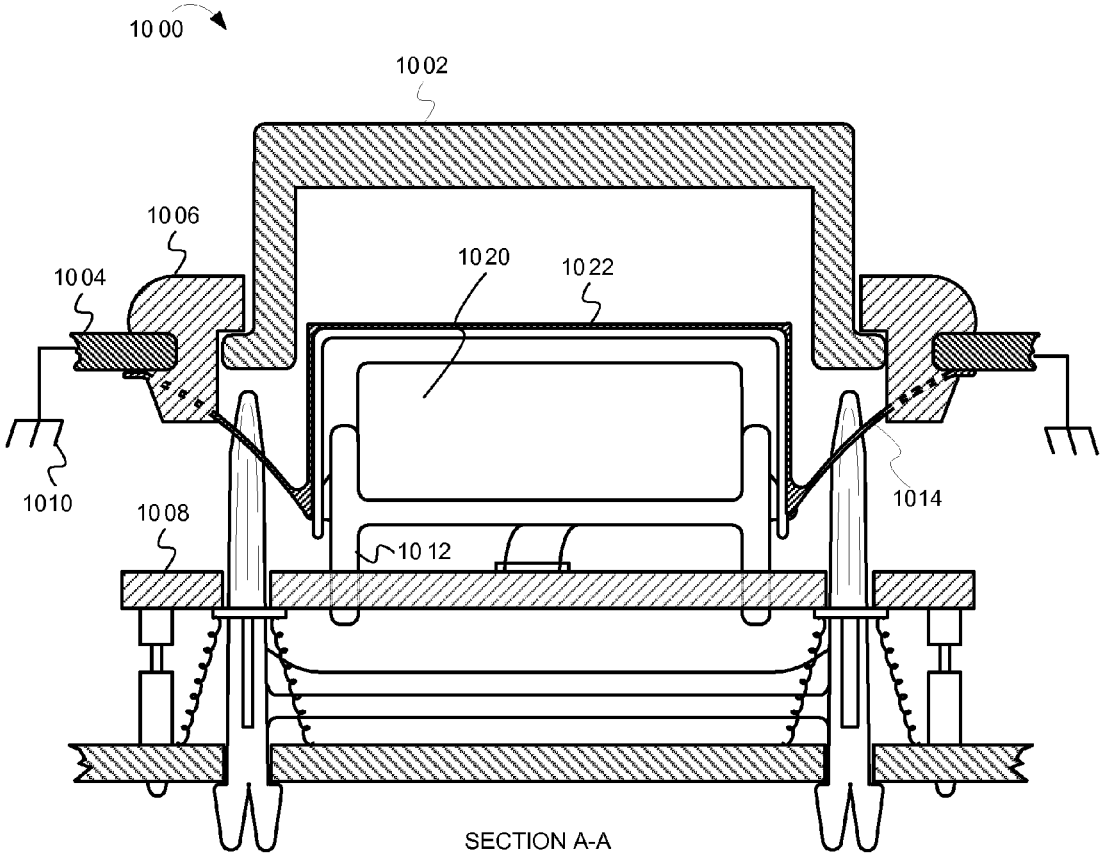
FIG. 10 is a cross-sectional view of a button assembly including a conductive cover over an OLED display and other components, according to some embodiments.

FIG. 10 is a cross-sectional view of a button assembly including a conductive cover over an OLED display and other components, according to some embodiments. In FIG. 10, the button assembly 1000 includes a panel 1004, bezel 1006, and cap 1002. The panel 1004 is connected to an electrical ground 1010. An OLED display 1020 sits beneath the cap 1002. The OLED display 1020 is supported by a frame 1012, which is connected to a display PCB 1008. A conductive cover 1022 sits over the OLED display 1020 and is in contact with the panel 1004, forming a ground path from the conductive cover 1022, through the panel 1004, terminating at the electrical ground 1010. The conductive cover 1022 includes arms 1014. The conductive cover 1022 can be coated with a conductive material or it can be made from a conductive material.

In some embodiments, the button assembly 1000 is divided into an upper panel and lower panel. The upper panel can include the panel 1004, bezel 1006, and cap 1002, whereas the lower panel can include the PCBs, OLED 1022, conductive cover 1022, etc. During assembly, as the upper and lower panels are placed in mechanical registration, the conductive cover's arms 1014 can flex when they contact the panel 1004. In some embodiments, when the upper and lower panels are fastened together, the arms 1014 remain in a flexed position, pressing firmly against the panel 1004.

Therefore, the button assembly's conductive cover 1022 and ground paths can protect the OLED display 1020 and other electronic components from harmful ESD. This section continues with a discussion of embodiments shown in FIG. 11.

Figure 11:
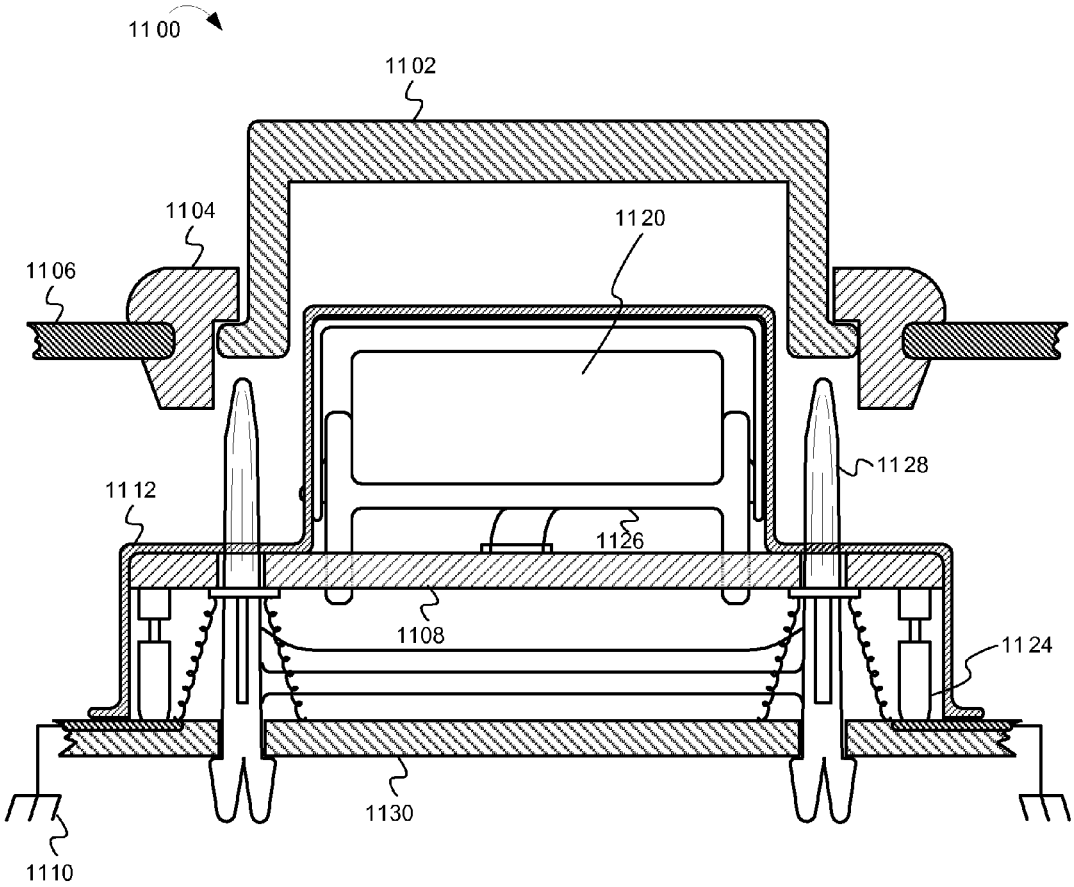
FIG. 11 is a cross-sectional view of a button assembly including a conductive shroud over an OLED display.

FIG. 11 is a cross-sectional view of a button assembly including a conductive shroud over an OLED display. In FIG. 11, the button assembly 1100 includes a panel 1106, bezel 1104, and cap 1102. An OLED display 1120 and other electronic components sit beneath the cap 1102. The OLED display 1120 is supported by a frame 1126, which is connected to a display PCB 1108. A conductive shroud 1112 sits over the OLED display 1120 and display PCB 1108. The switch actuators 1128 protrude through the conductive shroud 1112.

As shown, the conductive shroud 1112 is connected to the main PCB 1130. Ground paths run through the conductive shroud 1112, to the main PCB 1130, and on to the electrical grounds 1110. In some embodiments, the conductive shroud 1112 does not extend to the main PCB 1130. In some embodiments, the conductive shroud 1112 is connected to the display PCB 1108, forming ground paths from the conductive shroud 1112, through the connector headers 1124, to the electrical grounds 1110.

As such, the conductive shroud 1112 can protect the OLED display 1120 and other electronic components from harmful ESD. This section continues with a discussion of embodiments shown in FIG. 12.

Figure 12:
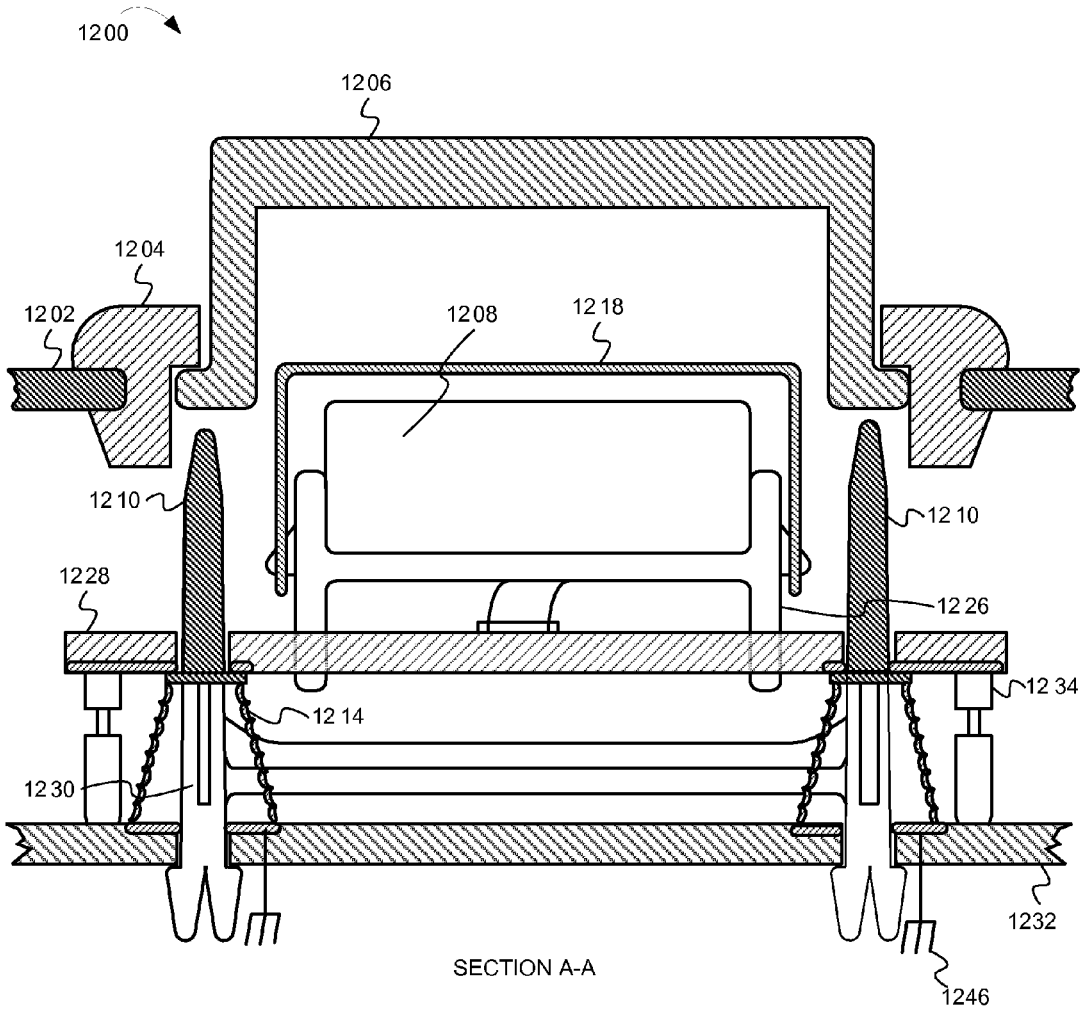
FIG. 12 is a cross-sectional view of a button assembly including a static dissipative cap and conductive switch actuators.

FIG. 12 is a cross-sectional view of a button assembly including a static dissipative cap and conductive switch actuators. In FIG. 12, the button assembly 1200 includes a panel 1202, bezel 1204, and static dissipative cap 1206. An OLED display 1208 sits beneath the cap 1206. In some embodiments, the OLED display 1208 is supported by a frame 1226 and fully or partially surrounded by a dielectric cover 1218. The frame 1226 is connected to a display PCB 1228. Switch actuators 1210 pass through the display PCB 1228 and ride on actuator springs 1214. The switch actuators 1210 are supported by studs 1230 that are anchored the main PCB 1232. The switch actuators 1210 can be coated with or constructed from conductive material. The display PCB 1228 is connected to the main PCB 1232 by the connector header 1234. As a result, A ground path runs from the static dissipative cap 1206, through the switch actuators 1210, through the actuator springs 1214 to an electrical ground 1246. Additionally, there are ground paths leading from the switch actuators 1210, through the display PCB 1228, down the connector headers 1234, through the main PCB 1232, and to the electrical grounds 1246. As a result the button assembly 1200 includes components that can protect the OLED display 1208 and other electronics from harmful ESD.

More about Wagering Game Machines

This section provides more information about wagering game machines.

Figure 13:
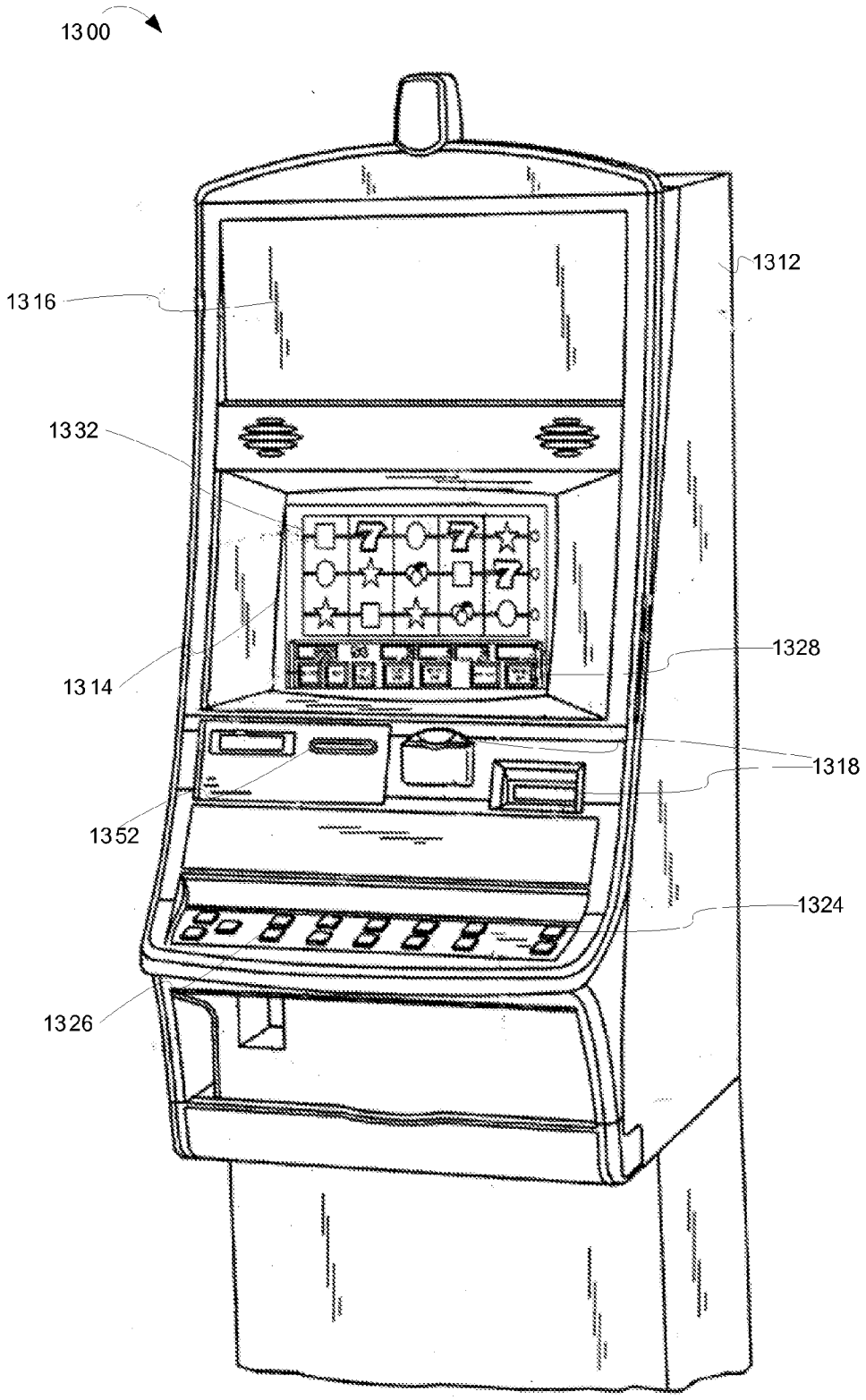
FIG. 13 is a perspective view of a wagering game machine, according to example embodiments of the invention.

FIG. 13 is a perspective view of a wagering game machine, according to example embodiments of the invention. Referring to FIG. 13, a wagering game machine 1300 is used in gaming establishments, such as casinos. According to embodiments, the wagering game machine 1300 can be any type of wagering game machine and can have varying structures and methods of operation. For example, the wagering game machine 1300 can be an electromechanical wagering game machine configured to play mechanical slots, or it can be an electronic wagering game machine configured to play video casino games, such as blackjack, slots, keno, poker, blackjack, roulette, etc.

The wagering game machine 1300 comprises a housing 1312 and includes input devices, including value input devices 1318 and a player input device 1324. For output, the wagering game machine 1300 includes a primary display 1314 for displaying information about a basic wagering game. The primary display 1314 can also display information about a bonus wagering game and a progressive wagering game. The wagering game machine 1300 also includes a secondary display 1316 for displaying wagering game events, wagering game outcomes, and/or signage information. While some components of the wagering game machine 1300 are described herein, numerous other elements can exist and can be used in any number or combination to create varying forms of the wagering game machine 1300.

The value input devices 1318 can take any suitable form and can be located on the front of the housing 1312. The value input devices 1318 can receive currency and/or credits inserted by a player. The value input devices 1318 can include coin acceptors for receiving coin currency and bill acceptors for receiving paper currency. Furthermore, the value input devices 1318 can include ticket readers or barcode scanners for reading information stored on vouchers, cards, or other tangible portable storage devices. The vouchers or cards can authorize access to central accounts, which can transfer money to the wagering game machine 1300.

The player input device 1324 comprises a plurality of push buttons on a button panel 1326 for operating the wagering game machine 1300. In addition, or alternatively, the player input device 1324 can comprise a touch screen 1328 mounted over the primary display 1314 and/or secondary display 1316.

The various components of the wagering game machine 1300 can be connected directly to, or contained within, the housing 1312. Alternatively, some of the wagering game machine's components can be located outside of the housing 1312, while being communicatively coupled with the wagering game machine 1300 using any suitable wired or wireless communication technology.

The operation of the basic wagering game can be displayed to the player on the primary display 1314. The primary display 1314 can also display a bonus game associated with the basic wagering game. The primary display 1314 can include a cathode ray tube (CRT), a high resolution liquid crystal display (LCD), a plasma display, light emitting diodes (LEDs), or any other type of display suitable for use in the wagering game machine 1300. Alternatively, the primary display 1314 can include a number of mechanical reels to display the outcome. In FIG. 13, the wagering game machine 1300 is an "upright" version in which the primary display 1314 is oriented vertically relative to the player. Alternatively, the wagering game machine can be a "slant-top" version in which the primary display 1314 is slanted at about a thirty-degree angle toward the player of the wagering game machine 1300. In yet another embodiment, the wagering game machine 1300 can exhibit any suitable form factor, such as a free standing model, bartop model, mobile handheld model, or workstation console model.

A player begins playing a basic wagering game by making a wager via the value input device 1318. The player can initiate play by using the player input device's buttons or touch screen 1328. The basic game can include arranging a plurality of symbols along a payline 1332, which indicates one or more outcomes of the basic game. Such outcomes can be randomly selected in response to player input. At least one of the outcomes, which can include any variation or combination of symbols, can trigger a bonus game.

In some embodiments, the wagering game machine 1300 can also include an information reader 1352, which can include a card reader, ticket reader, bar code scanner, RFID transceiver, or computer readable storage medium interface. In some embodiments, the information reader 1352 can be used to award complimentary services, restore game assets, track player habits, etc.

The wagering game machines described above can be connected in wagering game networks. This section continues with a brief discussion about wagering game networks.

Figure 14:
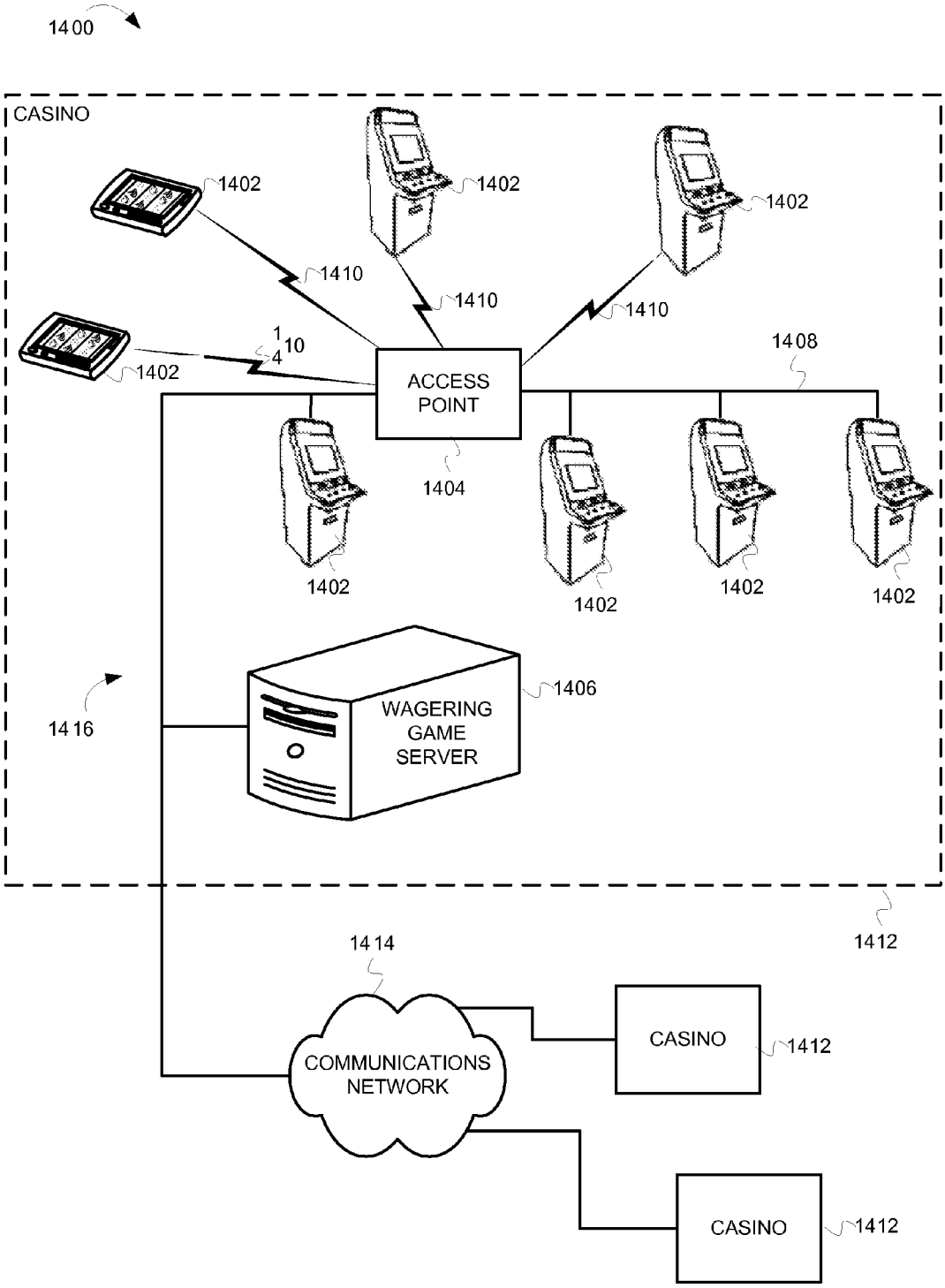
FIG. 14 is a block diagram illustrating a wagering game network 1400, according to example embodiments of the invention.

FIG. 14 is a block diagram illustrating a wagering game network 1400, according to example embodiments of the invention. As shown in FIG. 14, the wagering game network 1400 includes a plurality of casinos 1412 connected to a communications network 1414.

Each casino 1412 includes a local area network 1416, which includes an access point 1404, a wagering game server 1406, and wagering game machines 1402. The access point 1404 provides wireless communication links 1410 and wired communication links 1408. The wired and wireless communication links can employ any suitable connection technology, such as Bluetooth, 802.11, Ethernet, public switched telephone networks, SONET, etc. In some embodiments, the wagering game server 1406 can serve wagering games and distribute content to devices located in other casinos 1412 or at other locations on the communications network 1414.

The wagering game machines 1402 described herein can take any suitable form, such as floor standing models, handheld mobile units, bartop models, workstation-type console models, etc. Any of the wagering game machines 1402 can include the buttons and/or button panels described herein. Furthermore, the wagering game machines 1402 can be primarily dedicated for use in conducting wagering games, or can include non-dedicated devices, such as mobile phones, personal digital assistants, personal computers, etc. In one embodiment, the wagering game network 1400 can include other network devices, such as accounting servers, wide area progressive servers, player tracking servers, and/or other devices suitable for use in connection with embodiments of the invention.

In some embodiments, wagering game machines 1402 and wagering game servers 1406 work together such that a wagering game machine 1402 can be operated as a thin, thick, or intermediate client. For example, one or more elements of game play may be controlled by the wagering game machine 1402 (client) or the wagering game server 1406 (server). Game play elements can include executable game code, lookup tables, configuration files, game outcome, audio or visual representations of the game, game assets or the like. In a thin-client example, the wagering game server 1406 can perform functions such as determining game outcome or managing assets, while the wagering game machine 1402 can present a graphical representation of such outcome or asset modification to the user (e.g., player). In a thick-client example, the wagering game machines 1402 can determine game outcomes and communicate the outcomes to the wagering game server 1406 for recording or managing a player's account.

In some embodiments, either the wagering game machines 1402 (client) or the wagering game server 1406 can provide functionality that is not directly related to game play. For example, account transactions and account rules may be managed centrally (e.g., by the wagering game server 1406) or locally (e.g., by the wagering game machine 1402). Other functionality not directly related to game play may include power management, presentation of advertising, software or firmware updates, system quality or security checks, etc.

Any of the wagering game network components (e.g., the wagering game machines 1402) can include hardware and machine-readable media including instructions for performing the operations described herein.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is

1. A button assembly configured to generate input for use in association with a wagering game, the button assembly comprising:

a printed circuit board (PCB) connected to an electrical ground path;

an electronic display connected to the PCB by a conductive coupling, wherein the electronic display is configured to display video associated with the wagering game;

a frame connected to the PCB to support the electronic display;

a conductive cover for covering the electronic display, wherein the conductive cover includes a window through which the electronic display is visible, and wherein the conductive cover is connected to the conductive coupling;

a switch actuator connected to the PCB; and a cap in contact with the switch actuator, wherein the cap is configured to move with the switch actuator in response to pressure, and wherein the cap is configured to cover the conductive cover, and wherein the display device is visible through the cap.

2. The button assembly of claim 1, wherein the electronic display includes an organic light emitting diode display.

3. The button assembly of claim 1, wherein the conductive coupling includes a frame to support the electronic display, and wherein the conductive cover covers the frame.

4. The button assembly of claim 1 further comprising:

a first shield backing the PCB;

a second shield backing another PCB, wherein the first and second shields are connected to the electrical ground path.

5. The button assembly of claim 1, wherein the conductive cover covers the PCB.

6. The button assembly of claim 5, wherein the conductive cover includes a conductive window through which the electronic display is visible.

7. The button assembly of claim 1 further comprising:

a connector header to connect the PCB to another PCB, wherein the ground path runs through the connector header and the other PCB.

8. The button assembly of claim 1 further comprising:

an actuator connected to the PCB; and a cap for actuating the actuator, wherein the electronic display is visible through the cap.

9. A wagering game machine comprising:

a wagering game controller configured to present wagering games upon which monetary value can be wagered;

a button panel including, a first printed circuit board (PCB) connected to an electrical ground;

a second PCB connected to the first PCB by a conductive connector;

a video display device connected to the second PCB;

a frame connected to the second PCB to support the display device;

a conductive cover connected to the frame and surrounding the video display device, wherein the conducive cover includes a window through which the video display device is visible, a switch actuator connected to the second PCB ;

a cap in contact with the switch actuator, wherein the cap is configured to move with the switch actuator, and wherein the cap is configured to cover the video display device, and wherein the video display device is visible through the cap; and a bezel to retain the cap, wherein the bezel is coupled to a panel.

10. The wagering game machine of claim 9, wherein the cap includes static dissipative material, and wherein the bezel includes a conductive material, and wherein the panel is connected to an electrical ground.

11. The wagering game machine of claim 10 further comprising:

a conductive liner disposed between the cap and the display.

12. The wagering game machine of claim 9, wherein the frame, the switch actuator, the conductive connector and the first PCB form a path to the electrical ground.

13. The wagering game machine of claim 9 further comprising:

a dielectric shroud covering the video display device and the second PCB.

14. The wagering game machine of claim 9 further comprising:

a flexible conductive cover disposed between the video display device and the cap.

15. The wagering game machine of claim 9 further comprising:

a conductive shroud covering the video display device and the first and second PCBs, wherein the conductive shroud and the second PCB form a path to the electrical ground, and wherein the conductive shroud, the conductive connector, and the first PCB form a path to the electrical ground.

16. The wagering game machine of claim 9 further comprising:

a spring coupled to the switch actuator and the first PCB, wherein the spring is electrically connected to the electrical ground, wherein the cap is constructed of static dissipative material, wherein the switch actuator includes a conductive coating.

17. The wagering game machine of claim 9, wherein the video display device is configured to present information generated by the wagering game controller.

18. A button assembly configured to generate input for use in association with a wagering game, the button assembly comprising:

a first printed circuit board (PCB) connected to an electrical ground;

a second PCB connected to the first PCB by a conductive connector;

a video display device connected to the second PCB;

a frame connected to the second PCB to support the display device;

a conductive cover connected to the frame and surrounding the video display device, wherein the conducive cover includes a window through which the video display device is visible, a switch actuator connected to the second PCB ;

a cap in contact with the switch actuator, wherein the cap is configured to move with the switch actuator, and wherein the cap is configured to cover the video display device, and wherein the video display device is visible through the cap; and a bezel to retain the cap, wherein the bezel is coupled to a panel.

19. The button assembly of claim 18, wherein the cap includes static dissipative material, and wherein the bezel includes a conductive material, and wherein the panel is connected to an electrical ground.

20. The button assembly of claim 19 further comprising:

a conductive liner disposed between the cap and the video display device.

21. The button assembly of claim 18, wherein the frame, the switch actuator, the conductive connector and the first PCB form a path to the electrical ground.

22. The button assembly of claim 18 further comprising:

a dielectric shroud covering the video display device and the second PCB.

23. The button assembly of claim 18 further comprising:

a flexible conductive cover disposed between the video display device and the cap.

24. The button assembly of claim 18 further comprising:

a conductive shroud covering the video display device and the first and second PCBs, wherein the conductive shroud and the second PCB form a path to the electrical ground, and wherein the conductive shroud, the conductive connector, and the first PCB form a path to the electrical ground.

25. The button assembly of claim 18 further comprising:

a spring coupled to the switch actuator and the first PCB, wherein the spring is electrically connected to the electrical ground, wherein the cap is constructed of static dissipative material, wherein the switch actuator includes a conductive coating.

26. The button assembly of claim 18, wherein the video display device is configured to present information generated by the wagering game controller.

* * * * *